US005878544A

United States Patent [19]

McKinnon

[11] Patent Number: 5,878,544

[45] Date of Patent: Mar. 9, 1999

[54] STABILIZING SYSTEM FOR CONCRETE POURED WALLS WITHIN FOAM BLOCK FORMS

[76] Inventor: Gordon McKinnon, 119 S. Oregon Ave., Tampa, Fla. 33606

[21] Appl. No.: 678,334

[22] Filed: Jul. 11, 1996

[51] Int. Cl.[6] ..... E04B 1/02

[52] U.S. Cl. ..... 52/566; 52/293.2; 52/295; 52/439

[58] Field of Search ..... 52/293.2, 295, 52/439, 442, 566, 592.6, 223.4; 403/393, 396, 391

[56] References Cited

U.S. PATENT DOCUMENTS

| | | | |
|---|---|---|---|
| 791,380 | 5/1905 | Thompson | 52/439 X |
| 839,015 | 12/1906 | Loomis | 52/439 X |
| 931,616 | 8/1909 | Johanning | 52/439 X |
| 958,619 | 5/1910 | Frazier | 52/439 X |
| 1,649,909 | 11/1927 | McKeon | 52/439 X |
| 1,657,441 | 1/1928 | Huovinen | 52/293.2 |
| 2,118,936 | 5/1938 | Malinovszky | 52/439 X |
| 2,627,176 | 2/1953 | Levy | 52/293.2 X |
| 3,292,331 | 12/1966 | Sams | 52/439 X |
| 4,064,668 | 12/1977 | Carter | 52/295 |
| 4,249,354 | 2/1981 | Wynn | 52/439 X |
| 4,353,194 | 10/1982 | Norton | 52/293.2 X |
| 4,563,852 | 1/1986 | Achtenberg et al. | 52/293.2 X |
| 4,726,567 | 2/1988 | Greenberg | 52/293.2 X |
| 4,750,306 | 6/1988 | Granieri | 52/295 X |
| 5,007,218 | 4/1991 | Bengston et al. | 52/293.2 X |
| 5,038,541 | 8/1991 | Gibbar | 52/442 X |
| 5,138,808 | 8/1992 | Bengston et al. | 52/295 X |
| 5,379,562 | 1/1995 | Hohmann | 52/295 |
| 5,384,993 | 1/1995 | Phillips | 52/295 X |
| 5,404,685 | 4/1995 | Collins | 52/295 X |
| B1 5,007,218 | 4/1996 | Bengston et al. | 52/293.2 X |

FOREIGN PATENT DOCUMENTS

| | | |
|---|---|---|
| 151293 | 7/1951 | Australia . |

*Primary Examiner*—Carl D. Friedman
*Assistant Examiner*—Beth A. Aubrey
*Attorney, Agent, or Firm*—Frijouf, Rust & Pyle, P.A.

[57] ABSTRACT

An improved stabilizing system for a poured concrete wall utilizing interlocking foam blocks disposed on a foundation. The improved stabilizing system comprises a plurality of reinforcement members. The first ends of the reinforcement members are secured within the foundation to extend in a vertical orientation through internal cavities within the plurality of courses of the interlocking foam blocks. A plurality of retainers are disposed on the upper surface of the interlocking foam blocks. A plurality of binders secure the plurality of retainers to the plurality of reinforcement members for stabilizing the wall during the process of pouring a concrete material within the internal cavities of the interlocking foam blocks.

18 Claims, 11 Drawing Sheets

PRIOR ART

PRIOR ART

STABILIZING SYSTEM FOR CONCRETE POURED WALLS WITHIN FOAM BLOCK FORMS

BACKGROUND OF THE INVENTION

1. Field Of The Invention

This invention relates to a stabilizing system, and more particularly to a stabilizing system for use within a poured concrete wall of a building structure which utilizes interlocking foam block molds.

2. Background Of The Invention

In recent years, the prior art has seen an increased use of interlocking foam blocks for the construction of a building structure. A plurality of interlocking foam blocks are assembled to form a wall. Each of the plurality of interlocking foam blocks has a vertical aperture. Reinforcing steel bar was located between the plurality of interlocking foam blocks as well as being located with the vertical aperture of each of the plurality of interlocking foam blocks. The vertical aperture of each of the plurality of interlocking foam blocks are filled with a curable material such as a cementitious material or the like. Upon curing of the curable material, the building structure consists of a reinforced cementitious material located within the vertical aperture of each of the plurality of interlocking foam blocks.

Australian Patent 151,293 to Peter Lewis Bruning discloses a wall structure comprising a number of pillars, spaced apart and tied together by top and bottom horizontal members to afford an openwork frame, and pre-cast concrete walling slabs which rest one upon another and fill in the spaces between the pillars, characterized in that the pillars are formed with inwardly presented longitudinal rebates, that the ends of the walling slabs are formed with outwardly presented rebates to afford end flanges which are received in the pillar rebates and bear against the inwardly presented faces thereof, and that the walling slabs are retained in assembled relation one upon another by wooden or other strips which are secured to the innermost faces of the pillars and overlap the end flanges of the walling slabs.

U.S. Pat. No. 791,380 to Albert A. Thompson discloses a fence-post of plastic material having embedded in a face thereof a longitudinal strip flush with the face of the post, said strip having a longitudinal groove in its rear face having converging sides which meet, said groove receiving a portion of the material of the body of the post, in the form of a longitudinal ridge standing directly in the rear of the front face of the strip and in position to receive against its side faces the ends respectively of a staple driven through the strip.

U.S. Pat. No. 931,616 to H. H. Johanning discloses a cementitious post having a slotted channel in the face of the upper portion and an air chamber formed in the lower portion thereof, a strip filling said channel, wire netting embedded in the post throughout the extent thereof, said netting being located near the surface of the post with its longitudinal edges spaced apart and turned back at acute angles, all substantially as shown and described.

U.S. Pat. No. 958,619 to L. F. Frazier discloses a fence post consisting of a concrete base having a surface area greater than the post. A core rises centrally from and integral with said base, and exterior tile encloses said core and extends from the top of the post downwardly to and into the concrete base. The tile having one face recessed and a wooden strip secured in said recess.

U.S. Pat. No. 1,649,909 to T. F. McKeon discloses a concrete fence post comprising a main body portion, a pair of longitudinally extending spaced reinforcing strips, of a width slightly less than the thickness of said post, embedded in said post and having their longitudinal edges within the marginal limits of said post; U-shaped clips for embracing said strips at their longitudinal edges for retaining the same in operative relative position, the outer ends of said U-shaped clips being flared outwardly for preventing their removal from the concrete poured around said strips; a wooden strip embedded in said main body portion between said reinforcing strips and having its inner face projecting inwardly of one of the longitudinal edges of said strips, the outer face of said wooden strip lying flush with one of the faces of said post; U-shaped clips embedded in said post, the legs of said U-shaped clips engaging opposite faces of said wooden strip in said post and the bight of said U-shaped clips lying snugly in engagement with the outer surface of said wooden strip, the ends of said legs of said U-shaped clips being angularly turned for preventing their removal from said post.

Although the use of interlocking foam blocks for the construction of a building structure has increased the efficiency of the construction of a building structure, the use of interlocking foam blocks of the prior art has certain disadvantages. A significant disadvantage of the interlocking foam blocks of the prior art is the difficulty of affixing an to outer and/or an inner facing material to the foam building blocks.

In my prior U.S. patent application, Ser. No. 08/581,366 filed Dec. 29, 1995, I disclosed a novel method and apparatus for providing an improved mounting for attaching a facing material to a poured concrete wall within foam block molds. U.S. patent application, Ser. No. 08/581,366 filed Dec. 29, 1995 set forth a improved mounting for stabilizing the foam blocks during the process of erecting and positioning the foam blocks as well as during the process of pouring of the concrete within the cores of the foam blocks.

It is an object of the present invention to improve upon my aforementioned invention and provide a stabilizing system for a concrete poured wall within foam blocks which is adaptable for use with my prior invention set forth in U.S. patent application Ser. No. 08/581,366 filed Dec. 29, 1995, as well as being applicable to the foam mold blocks of the prior art.

Another object of this invention is provide a stabilizing system for use within a poured concrete wall of a building structure which stabilizes the foam blocks during the erection and assembly process.

Another object of this invention is to provide a stabilizing system for use within a poured concrete wall of a building structure which stabilizes the foam mold blocks during the process of pouring of the concrete within the foam block.

Another object of this invention is to provide a stabilizing system for use within a poured concrete wall of a building structure which is able to interconnect a building plate on an upper surface of the concrete wall to the foundation of the building structure.

Another object of this invention is to provide a stabilizing system for use within a poured concrete wall of a building structure which does not appreciably raise the cost of the building structure.

Another object of this invention is to provide a stabilizing system for use within a poured concrete wall of a building structure which eliminates the need for externally reinforcing or stabilizing the foam mold blocks.

Another object of this invention is to provide a stabilizing system for use within a poured concrete wall of a building structure which provides a substantial material and labor savings in the elimination of external supports of the foam mold blocks.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved stabilizing system for a poured concrete wall utilizing foam blocks disposed on a foundation. Each of the foam blocks has an internal cavity for receiving a concrete material. The improved stabilizing system comprises a plurality of reinforcement members each having a first and a second end. The improved stabilizing system may optionally comprise a plurality of extension members each having a first and a second end. The first end of each of the plurality of reinforcement members is secured within the foundation with the second end of each of the plurality of reinforcement members extending in a vertical orientation. A plurality of coupling means secure the second ends of the plurality of reinforcement members to the first ends of the optional plurality of extension members with the plurality of extensions members extending in a vertical orientation. A plurality of courses of the foam blocks are disposed on the foundation with the plurality of members extending through the internal cavities within the foam blocks. A plurality of retainers is disposed on an upper surface of the plurality of courses of the foam blocks with a plurality of binders engaging with the second ends of the plurality of extension members for securing the plurality of retainers into engagement with the upper surface of the foam blocks for stabilizing the wall during the process of pouring a concrete material within the internal cavities of the foam blocks.

In a more specific embodiment of the invention, each of the plurality of reinforcement members and the plurality of extension members comprises a steel reinforcement bar. The means for securing the plurality of reinforcement members within the foundation comprises the reinforcement members being angled for securing each of the reinforcement members to the foundation. In another embodiment of the invention, the reinforcement members are secured to horizontally extending reinforcement members within the foundation.

In one embodiment of the invention, the coupling means comprises threaded ends on the plurality of reinforcement members and the extension members for threadably engaging with threads on a coupling device. In another embodiment of the invention, the coupling means comprises a first and a second deformed portion for securing the reinforcement members to the extension members.

In still another embodiment of the invention, the coupling means comprises an aperture in each of the ends of the reinforcement members and the extension members. The coupling means includes a first and second coupling aperture for enabling a first and a second fastener to engage said apertures for securing the reinforcement member to the extension members.

Preferably, each of the plurality of binders are removable for enabling the removal of the retainer after the internal cavities of the foam blocks are filled with the concrete material. The plurality of binders may comprise a threaded binder.

In another embodiment of the invention, a construction plate has a plurality of plate apertures for engaging the upper surface of the plurality of courses of the foam blocks with the second ends of the plurality of extension members extending through the plurality of plate apertures. The plurality of binders engage with the second ends of the plurality of extension members for securing the construction plate to the upper surface of the plurality of courses of the interlocking foam blocks.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
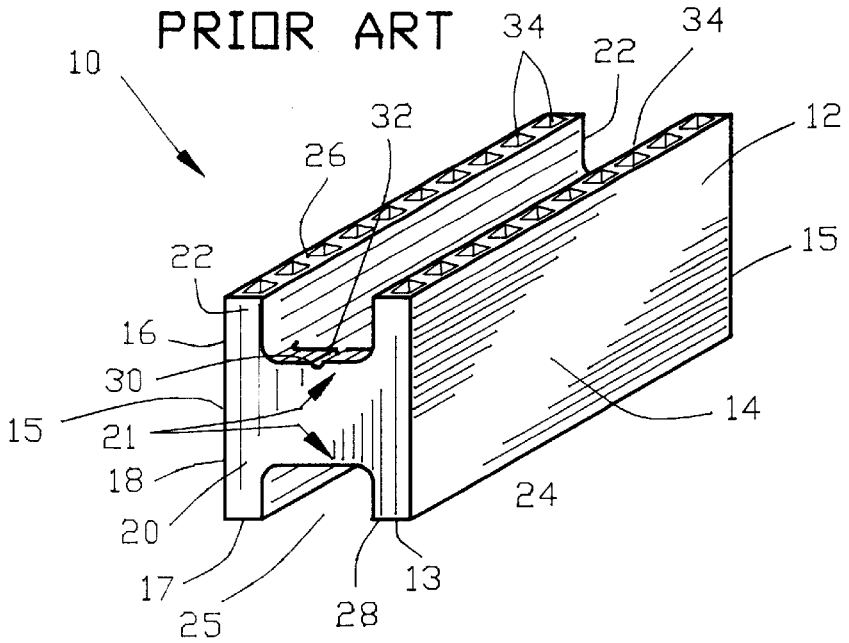
FIG. 1 is an isometric view of an interlocking block as used in the prior art illustrating a top surface, a face surface and a first end surface.
Figure 2:
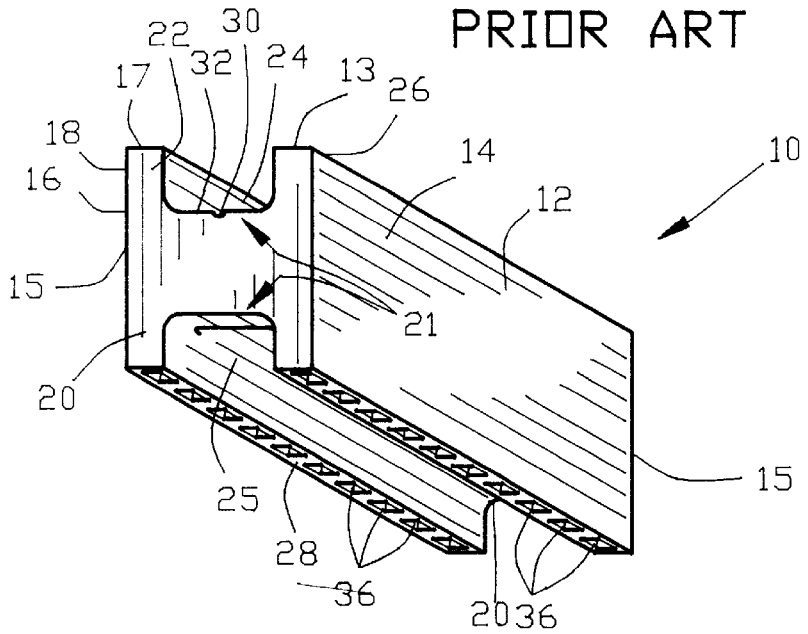
FIG. 2 is an isometric view of the interlocking block as used in the prior art illustrating a bottom surface, the face surface and the first end surface.

FIG. 1 is an upper isometric view whereas FIG. 2 is a lower isometric view of an interlocking block 10 as used in the prior art. The interlocking block 10 of the prior art is typically manufactured of a foam material such as a closed cell foam. The interlocking block 10 comprises a first rectangular section 12 having a thickness 13, a height 15 and a face surface 14. A second rectangular section 16 has a thickness 17, a height 15 and a face surface 18. The first rectangular section 12 and the second rectangular section 16 are located as parallel planes. Plural end sections 20 have a height 21 substantially less than the height 15 and 17 of first and second rectangular sections 12 and 16. The plural end sections 20 are disposed transverse to and communicate with the first rectangular section 12 and the second rectangular section 16. The plural end sections 20 include a face 22 being positioned to provide a substantially equal upper aperture 24 and a lower aperture 25 in the end section 20 located proximate to the top face 26 and the bottom face 28 of the interlocking block 10. A recess 30 is disposed in each of the top surfaces 32 of the plurality of end sections 20 and central sections 38. The recess 30 are disposed substantially equidistant between the first rectangular section 12 and second rectangular section 16. A plurality of protrusions 34 are disposed proximate to the top face 26 of first and second rectangular sections 12 and 16. A plurality of cavities 36 are disposed proximate to the bottom face 28.

Figure 3:
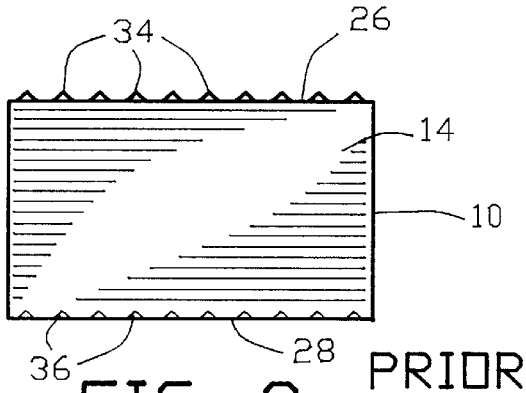
FIG. 3 PRIOR ART
FIG. 3 is a view of the face surface of the interlocking block as used in the prior art.
Figure 4:
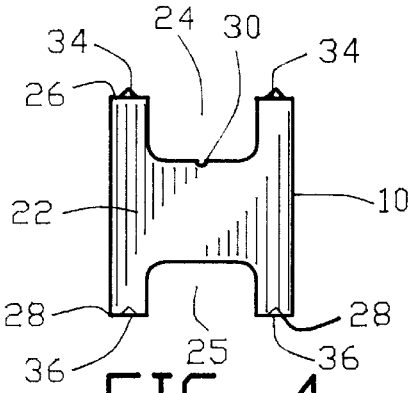
FIG. 4 PRIOR ART
FIG. 4 is an end view of the first end of the interlocking block as used in the prior art.
Figure 5:
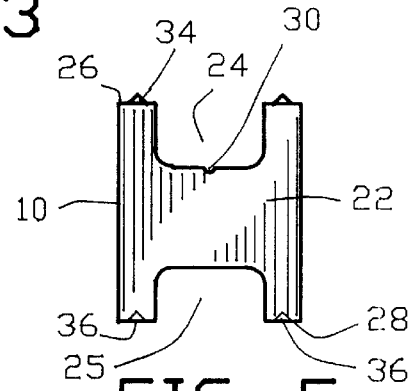
FIG. 5 PRIOR ART
FIG. 5 is an end view of a second face of the interlocking block as used in the prior art.
Figure 6:
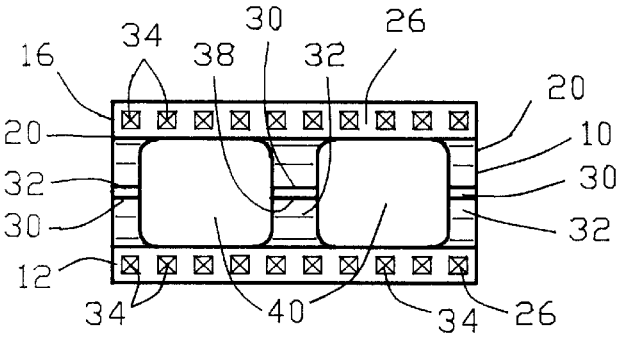
FIG. 6 PRIOR ART
FIG. 6 is a top view of the interlocking block as used in the prior art.
Figure 7:
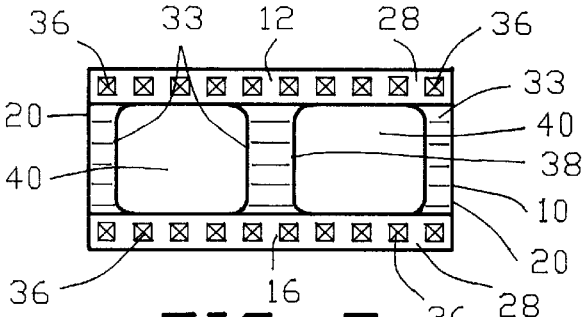
FIG. 7 is a bottom view of the interlocking block as used in the prior art.

FIG. 3 is an elevation view of the interlocking block 10 with FIGS. 4 and 5 being left and right side views thereof. FIGS. 6 and 7 are top and bottom views of FIG. 3. A plurality of vertical apertures 40 communicates with the top surface 32 of the end sections 20 and the central section 38 and extends to and communicates with the bottom surface 33 of the end sections 20 and the central section 38.

Figure 8:
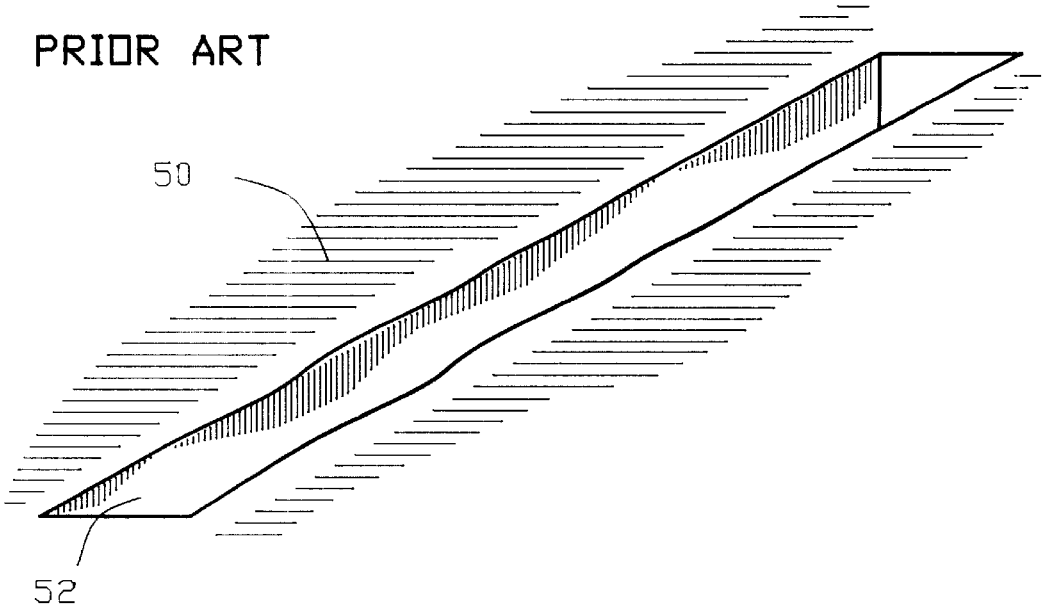
FIG. 8 PRIOR ART
FIG. 8 is an isometric view of a trench in a ground surface for a poured concrete foundation.

FIG. 8 is an isometric view of a ground surface 50 defining a trench 52. The trench 52 is excavated to be of suitable depth and thickness for function as a foundation for the intended building structure as should be well known to those skilled in the art.

Figure 9:
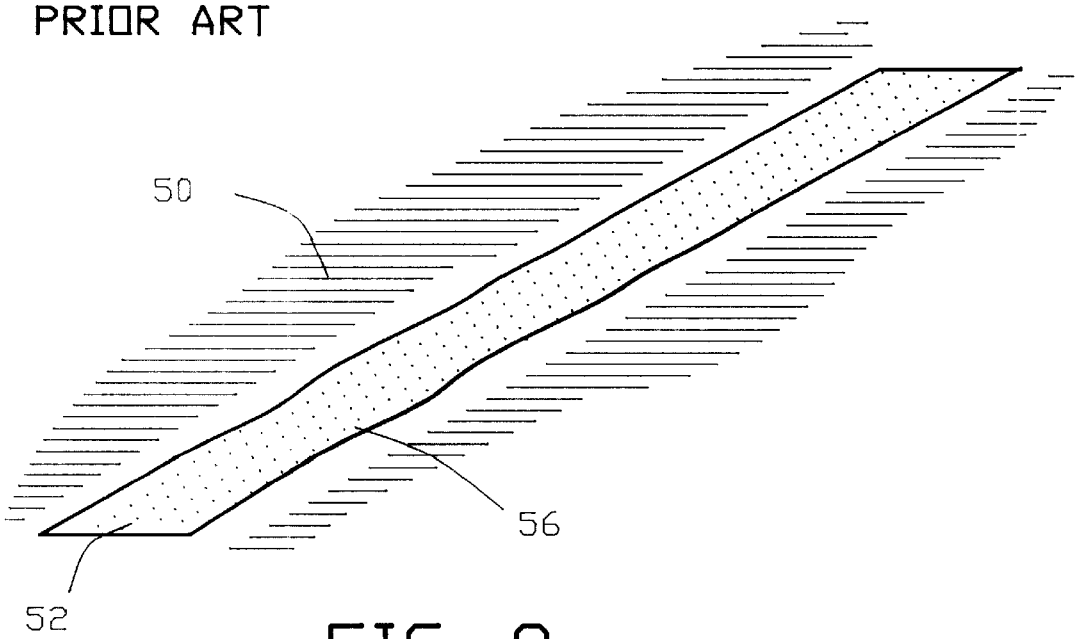
FIG. 9 is an isometric view of the trench of FIG. 8 with a poured concrete foundation.

FIG. 9 is an isometric view of the trench 52 of FIG. 8 with a poured concrete foundation 56. The poured concrete foundation 56 may be formed with a plurality of steel reinforcing members (not shown) commonly referred to as "rebar" for adding mechanical strength to the concrete foundation 56. The poured concrete foundation 56 provides a base for the construction with the interlocking block 10 as will be described in greater detail hereinafter.

Figure 10:
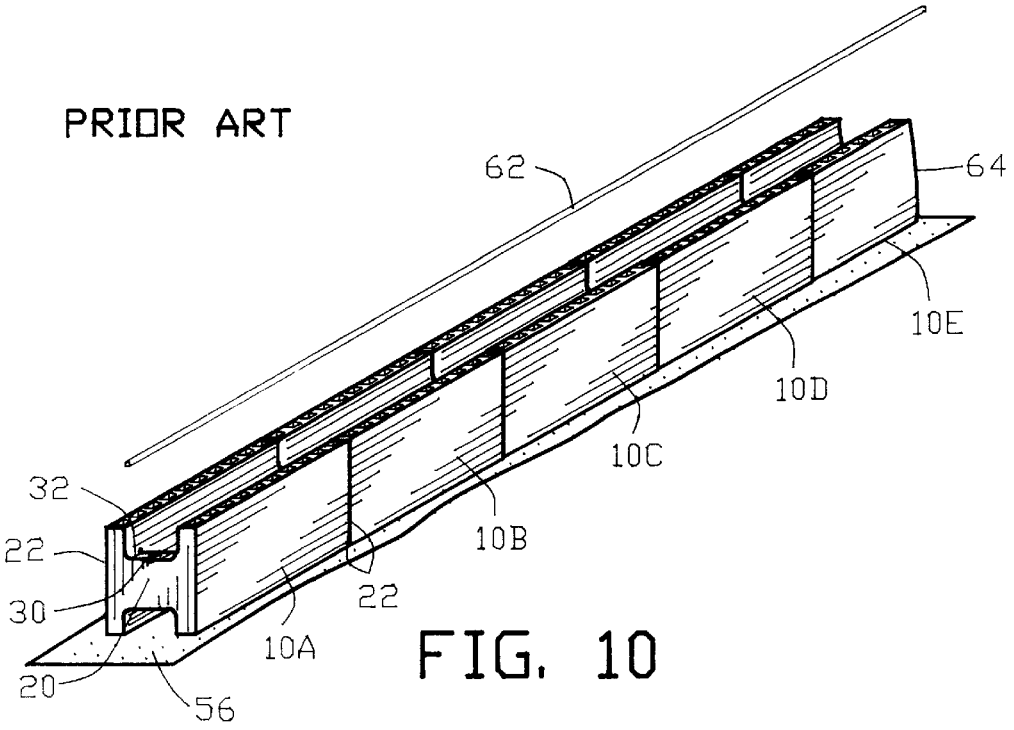
FIG. 10 is an isometric view of a first layer of interlocking blocks illustrating the top surfaces, the face surfaces, the end surfaces and reinforcing means.

FIG. 10 is an isometric view of a first layer 64 of the blocks 10 wherein the end face 22 of a first block 10A is positioned proximate the end face 22 of a second block 10B. The first layer 64 of the blocks comprises blocks 10A–10E resting on the poured concrete foundation 56. Reinforcing means 62 shown as a steel reinforcing bar is illustrated prior to positioning in the plurality of recesses 30 in the top surfaces 32 of the end sections 20 and the central sections 38.

Figure 11:
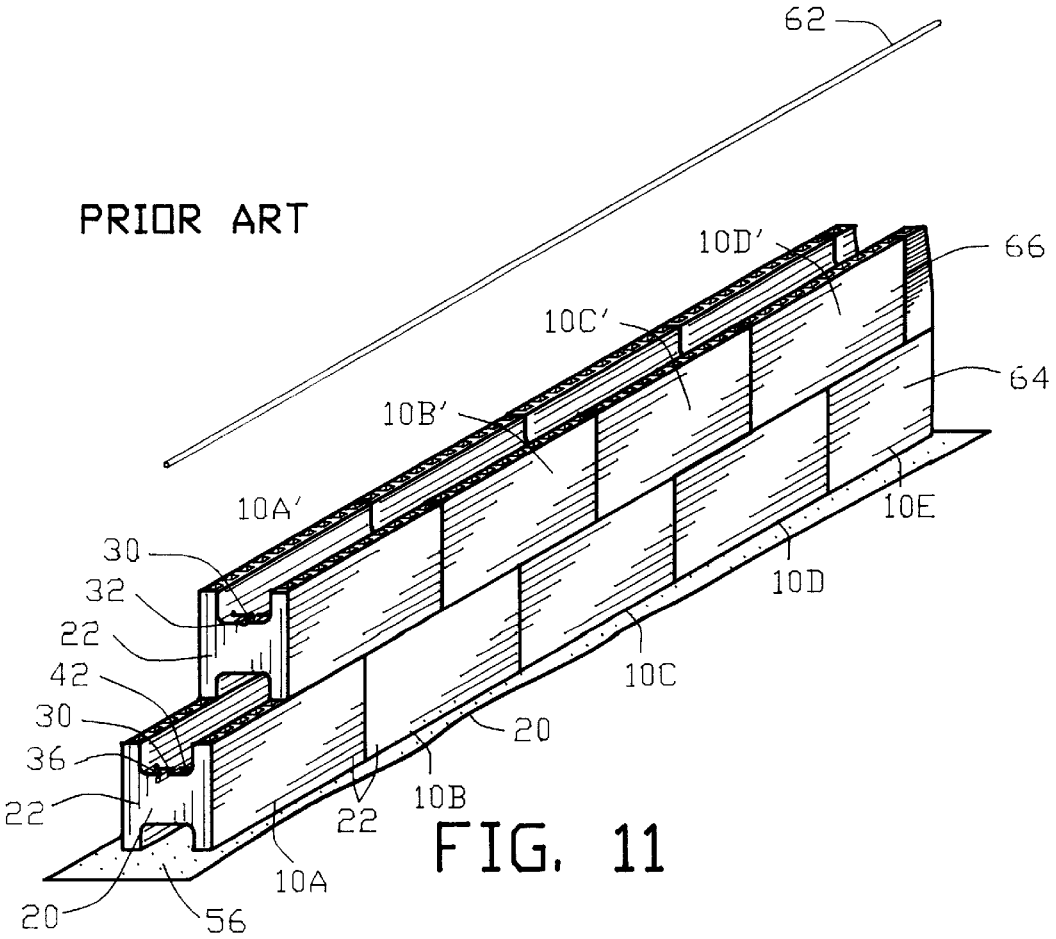
FIG. 11 is an isometric view of a second layer of interlocking blocks assembled on the first layer of the interlocking blocks as used in the prior art illustrating the top surfaces, the face surfaces, the end surfaces and reinforcing means.

FIG. 11 is an isometric view of a second layer 66 of the blocks 10' disposed upon the first layer 64 of blocks. The first layer 64 of blocks 10 comprises blocks 10A–10E whereas the second layer 66 of blocks comprises blocks 10A'–10D'. The reinforcing means 62 is positioned in plurality of recesses 30 in the top surfaces 32 of the end sections 20 and the central sections 38 of the first layer 64. The second layer 66 of blocks 10' comprises a first block 10A' positioned with bottom face 28 of first block 10A' of second layer 66 proximate top face 26 of block 10A of first layer 64 of blocks 10.

The plurality of protrusions 34 disposed proximate to the top face 26 of the blocks 10A–10E of the first layer 64 are received within the plurality of cavities 36 disposed proximate to the bottom face 28 of the blocks 10A'–D' of the second layer 66. The reception of the protrusions 34 of the blocks 10A–10E of the first layer 64 by the plurality of cavities 36 in the blocks 10A'–D' of the second layer 66 interlocks the blocks of the blocks 10A–10E of the first layer 64 to the blocks 10A'–10D' of the second layer 66.

The second layer 66 is staggered relative to first layer 64 wherein a plane extending from interface of the first and second end face 22 of the blocks 10A and 10B bisects a first block 10A' in second layer 66 of the blocks 10. The blocks 10' of second layer 66 are positioned relative to the blocks 10 of the first layer 64 to enable the protrusions 34 in the blocks 10 to be received within the cavities 36 of the blocks 10' for interlocking the blocks 10 and 10'. The reinforcing means 62 is illustrated prior to positioning in the plurality of recesses 30 in the top surfaces 32 of the end sections 20 and the central sections 38. The plurality of vertical apertures 40 in the blocks 10 and 10' communicating with the upper apertures 24 and the lower apertures 25 provides a contiguous void matrix 76 for accepting slurry of curable material 72 such as concrete or the like.

Figure 12:
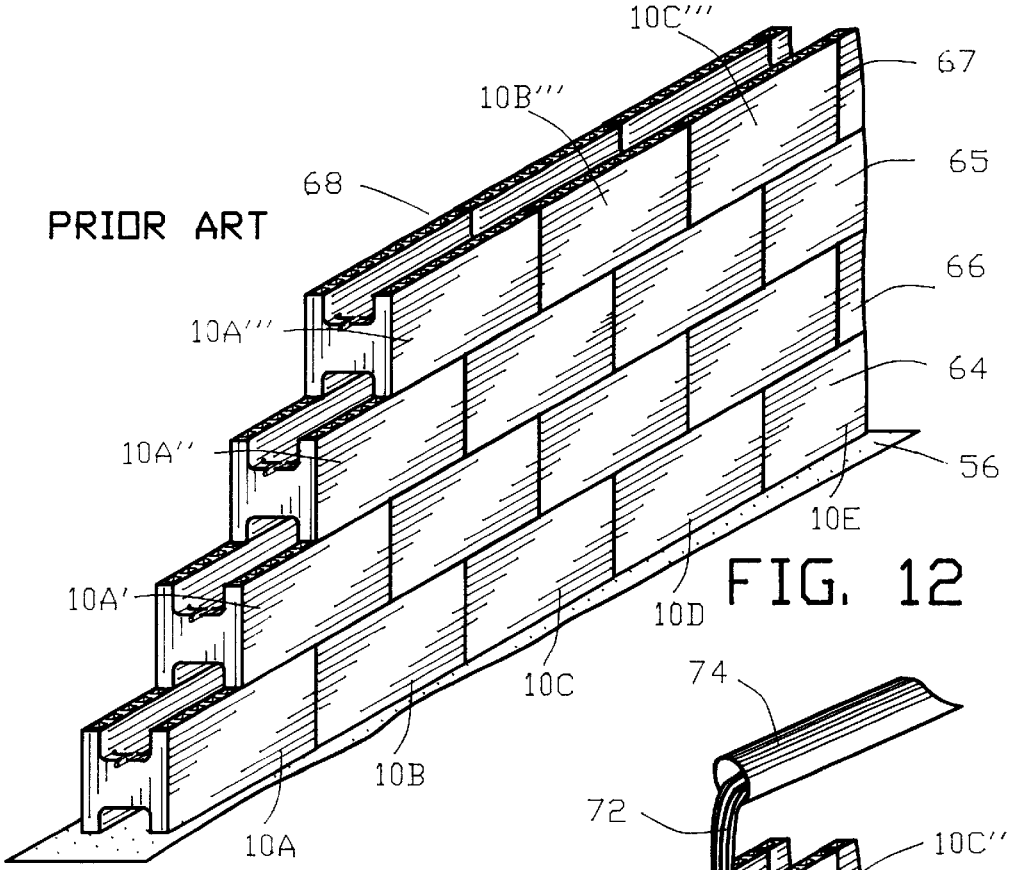
FIG. 12 is an isometric view of a wall comprising four layers of interlocking blocks as used in the prior art illustrating the top surfaces, the face surfaces and the end surfaces.
Figure 13:
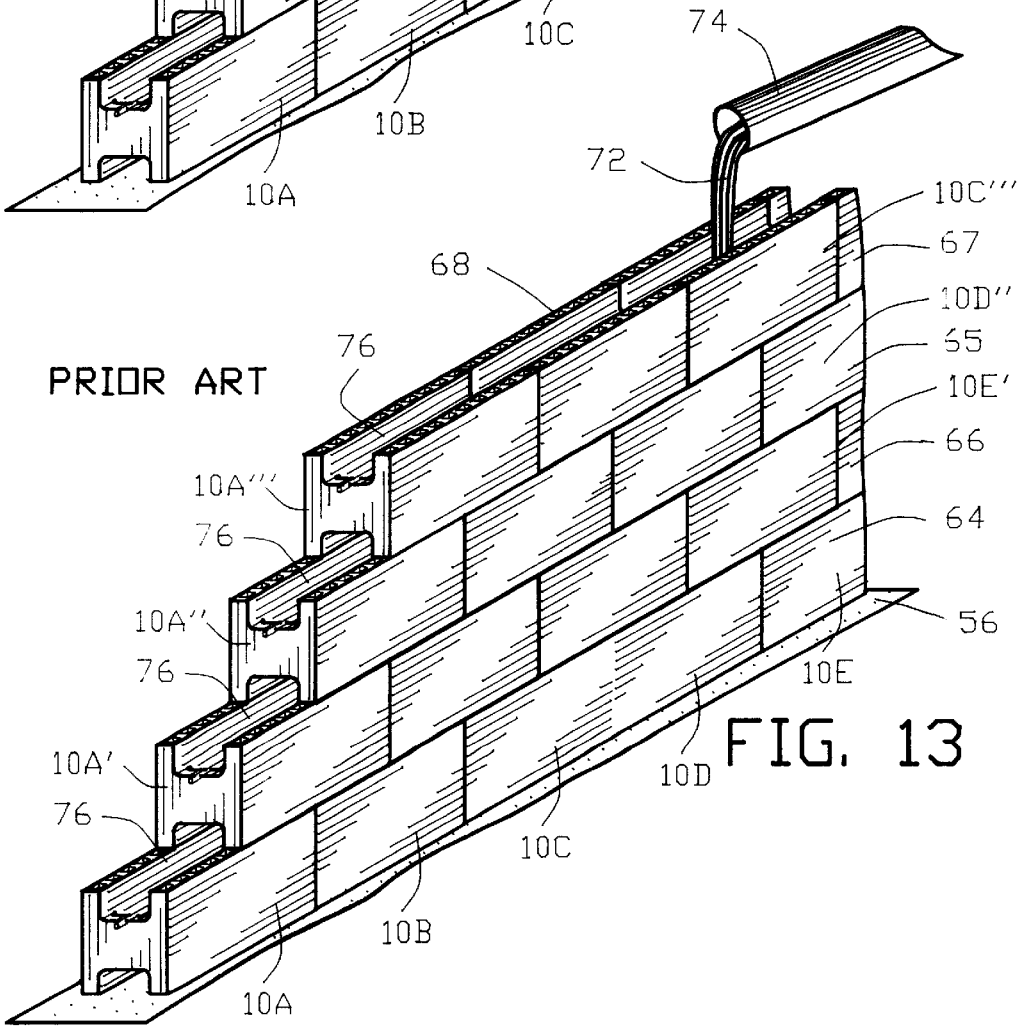
FIG. 13 is an isometric view of the wall comprising four layers of interlocking blocks as used in the prior art illustrating the top surfaces, the face surfaces, the end surfaces and the delivery of a slurry of curable material.

FIG. 12 is an isometric view of a plurality of layers 64–67 of blocks 10, 10', 10" and 10'" comprising the wall 68 constructed as previously described and illustrated in FIGS. 12 and 13. The blocks 10', 10" and 10'" are positioned relative to the blocks 10 of the lower layer to enable the protrusions 34 in the blocks 10 to be received within the cavities 36 of the blocks 10 for interlocking the blocks within the plurality of layers 64–67.

FIG. 13 is an isometric view of the plurality of layers 64–67 of the interlocking blocks 10, 10', 10" and 10'" comprising a wall 68 constructed as previously described and illustrated in FIGS. 8, 9 and 10. FIG. 11 further illustrates the delivery of slurry of curable material 72 such as a cementitious material, concrete or the like from a delivery means 74. The delivery means 74 delivers the slurry of the curable material 72 to the plurality of vertical apertures 40 in blocks 10'" of layer 67 which communicates with upper apertures 24 and lower apertures 25 and the plurality of vertical apertures 40 of the plurality of layers 64–67. The curable material 72 provides a contiguous matrix 76 of curable material 72 such as concrete or the like.

The use of interlocking blocks 10 for the construction of the wall 68 provides a wall structure that is stronger than a wall constructed from conventional concrete blocks. Furthermore, the use of interlocking blocks 10 for the construction of the wall 68 is easier and faster than the construction of a wall constructed from conventional concrete blocks. In addition, use of interlocking blocks 10 for the construction of the wall 68 provides a vapor barrier as well as insulation for the wall 68.

Although the use of interlocking blocks 10 for the construction of the wall 68 has provided a stronger and less expensive wall with a vapor barrier and insulation, the use of interlocking blocks of the prior art has certain disadvantages. One significant disadvantage in of the interlocking foam blocks 10 of the prior art shown in FIGS. 1–11 is the difficulty of affixing an outer and/or an inner facing material to the blocks 10. In addition, difficultly is encountered in maintaining the alignment and position of the blocks 10 within the plurality of layers 64–67 during the delivery of slurry of curable material 72.

Figure 14:
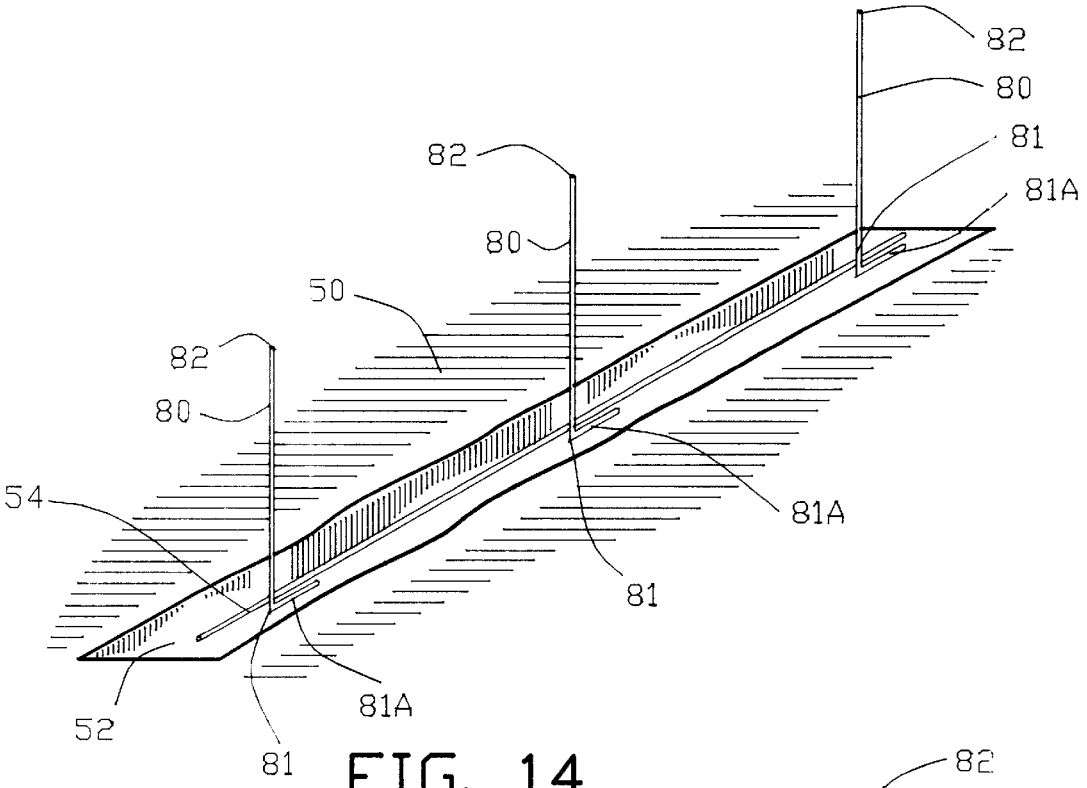
FIG. 14 is an isometric view of a trench in a ground surface with a horizontally disposed reinforcement member therein.

FIG. 14 is an isometric view of the ground surface 50 defining the trench 52. The trench 52 is excavated to be of suitable depth and thickness for function as a foundation for the intended building structure as should be well known to those skilled in the art. In this embodiment, a horizontally extending reinforcing member 54 commonly referred to as "rebar" is disposed within the trench 52 for adding mechanical strength to the concrete foundation 56. A plurality of reinforcement members 80 with each of the plurality of reinforcement members 80 having a first 81 and a second end 82 is partially located in the trench 52. Each of the plurality of reinforcement members comprises a steel reinforcement bar. The first ends 81 of the plurality of reinforcement members 80 may be angled at 81A for securing each of the reinforcement members 81 to the foundation 56. The first ends 81 of the plurality of reinforcement members 80 may be secured to the horizontally extending reinforcing member 54 by suitable wire ties as should be well known to those skilled in the art.

Figure 15:
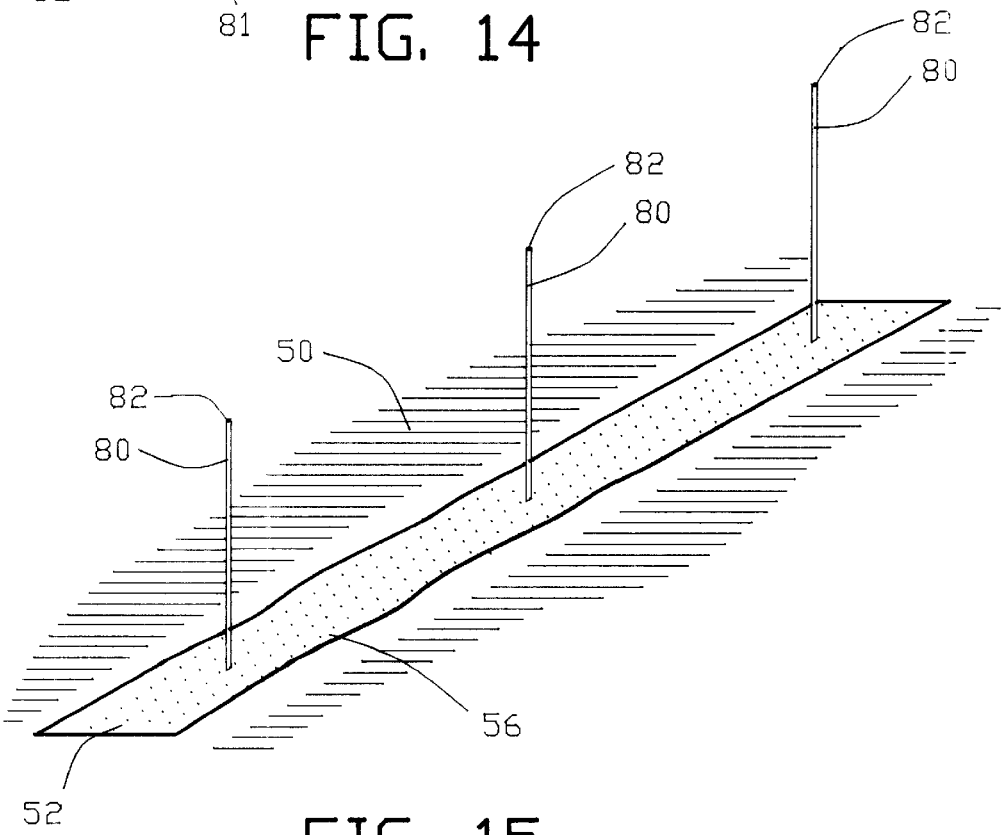
FIG. 15 is an isometric view of the trench of FIG. 14 with a poured concrete foundation with vertically disposed reinforcement members.

FIG. 15 is an isometric view of the trench 52 of FIG. 14 with a poured concrete foundation 56. The second ends 82 of each of the plurality of reinforcement members 80 extend from the foundation 56 in a vertical orientation. The angles 81A of each of the first ends 81 of the plurality of reinforcement members 80 enable the vertically extending reinforcement members 80 to withstand a substantial vertical upward force after curing of the foundation 56. The poured concrete foundation 56 provides a base for the construction with the interlocking block 110 as will be described in greater detail hereinafter.

Figure 16:
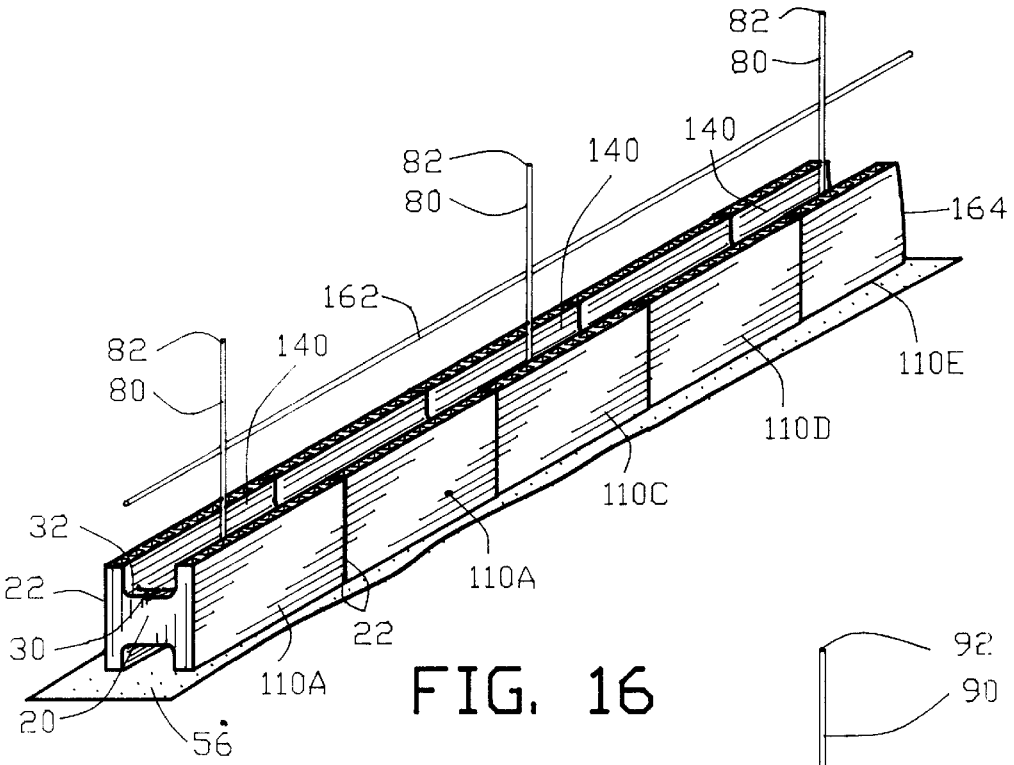
FIG. 16 is an isometric view of a first layer of interlocking blocks illustrating reinforcing means extending through the blocks.

FIG. 16 illustrates the erecting of a first course 164 of interlocking foam blocks 110 shown as interlocking foam blocks 110A–110E. It should be appreciated that the interlocking foam blocks 110 may be the interlocking foam blocks of the prior art or may be a new and improved foam block as set forth in my prior U.S. patent application, Ser. No. 08/581,366 filed Dec. 29, 1995.

The interlocking foam blocks 110 are placed such that the vertically extending reinforcement members 80 project through vertical apertures 140 of each of the interlocking foam blocks 110. After the first course 164 of the interlocking foam blocks 10 is positioned over the vertically extending reinforcement members 80, a horizontal reinforcement member 162 is placed upon the first course 164 of the interlocking foam blocks 110. Preferably, the horizontally extending reinforcement member 162 is secured to the vertically extended reinforcement members 80 by means such as wire, welding or the like.

Figure 17:
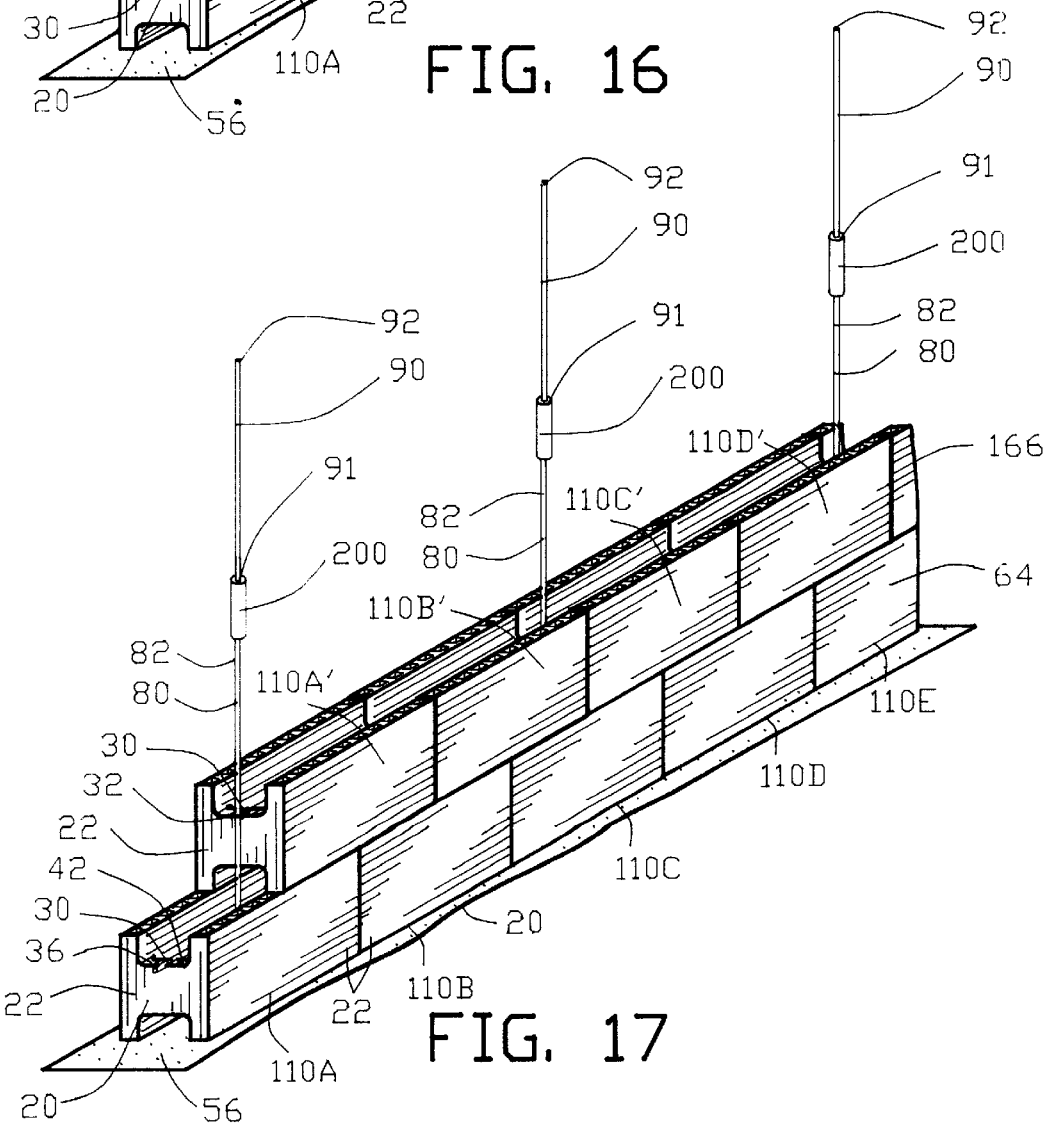
FIG. 17 is an isometric view of a second layer of interlocking blocks assembled on the first layer of the interlocking blocks.

FIG. 17 illustrates the erecting of a second course 166 of the interlocking foam blocks 110 shown as interlocking foam blocks 110A'–110D'. In a similar manner, the interlocking foam blocks 110 are placed such that the vertically extending reinforcement members 80 project through vertucal apertures 140 of each of the interlocking foam blocks 110. After the second course 166 of the interlocking foam blocks 110 is positioned over the vertically extending reinforcement members 80, another horizontal reinforcement member 162 is placed upon the second course 166 of the interlocking foam blocks 110. In some circumstances, it is necessary to accommodate for the increased height of the interlocking foam blocks 110 through the use of a plurality of vertically extending extension members 90. Preferably, each of the plurality of extension members 90 comprising a steel reinforcement bar and made of the same material as the vertically extending reinforcement members 80.

Each of the plurality of extension members 90 defines a first 91 and a second end 92. The second ends 82 of the plurality of reinforcement members 80 are connected to the first ends 91 of the plurality of extension members 90 with the plurality of extension members 90 extending in a vertical orientation. The plurality of extension members 90 may be secured to the vertically extending reinforcement members 80 by mechanical means, welding or by a suitable adhesive. In this embodiment, a plurality of coupling means 200 secure the second ends 82 of the plurality of reinforcement members 80 to the first ends 91 of the plurality of extension members 90 with the plurality of extension members 90 extending in a vertical orientation.

FIGS. 20–27 illustrate the examples of means for securing the second ends 82 of the plurality of reinforcement members 80 to the first ends 91 of the plurality of extension members 90. However, it should be understood that these means are meant to be merely illustrative and not to be limiting upon the various types of means which may be utilized for securing the reinforcement members 80 to the extension members 90.

Figure 18:
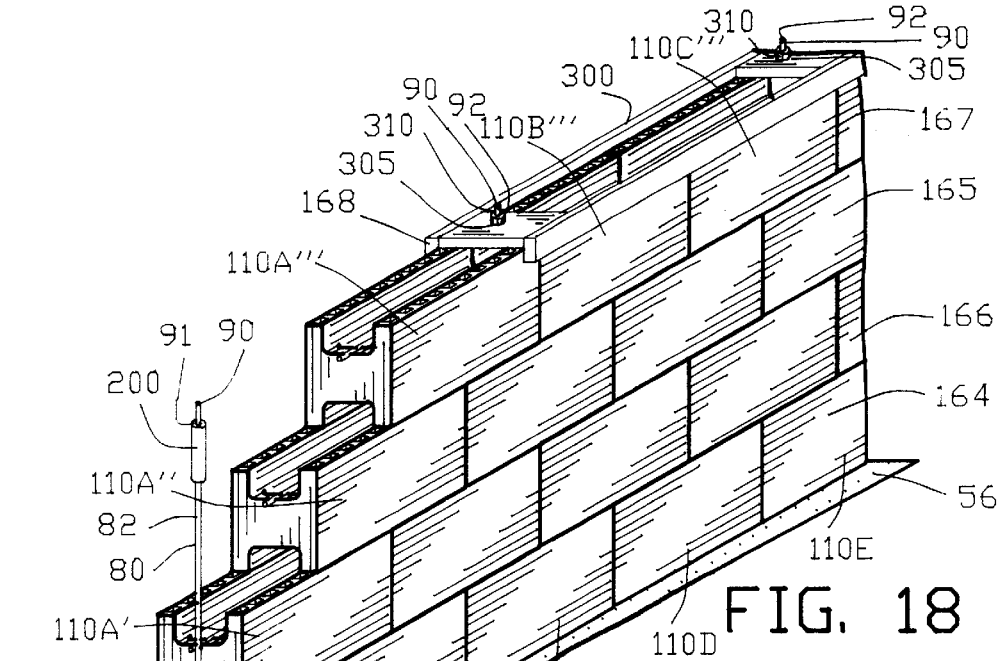
FIG. 18 is an isometric view of a wall comprising four layers of interlocking blocks with a retainer disposed on the interlocking blocks.
Figure 19:
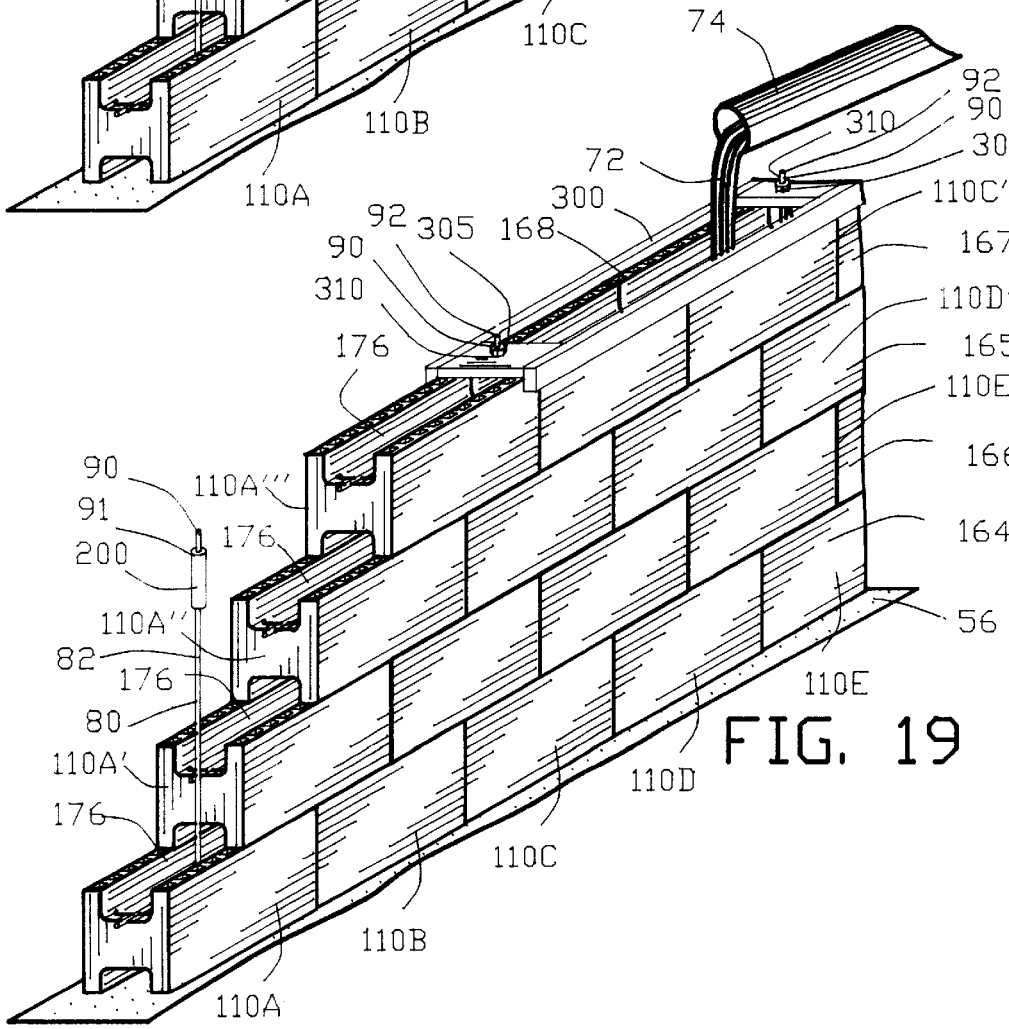
FIG. 19 is an isometric view of the wall comprising four layers of interlocking blocks illustrating the delivery of a slurry of curable material.
Figure 20:
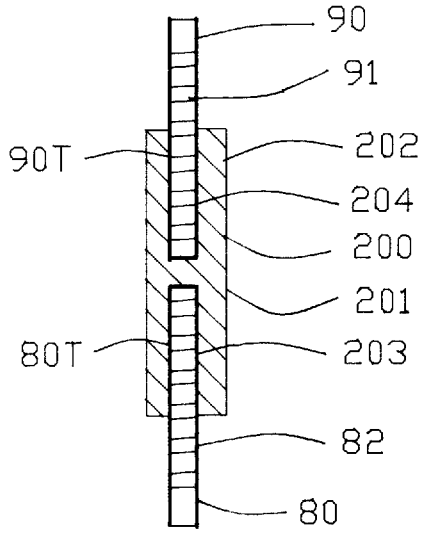
FIG. 20 is an enlarged view of a first embodiment of a coupling means shown in FIGS. 17–19 securing the plurality of extension members to the plurality of reinforcement members.

FIG. 20 is an enlarged view of a first embodiment of the coupling means 200 shown in FIGS. 17–19 for securing the plurality of extension members 90 to the plurality of reinforcement members 80. The coupling means 200 comprises a cylindrical member having a first and a second portion shown as a first and a second end 201 and 202 defining an upper and a lower coupling thread 203 and 204. The upper and lower coupling thread 203 and 204 respectively receives threads 80T and 90T defined on the second and first ends 82 and 91 of the reinforcement members 80 and the extension members 90 for securing the extension members 90 to the reinforcement members 80.

Figure 21:
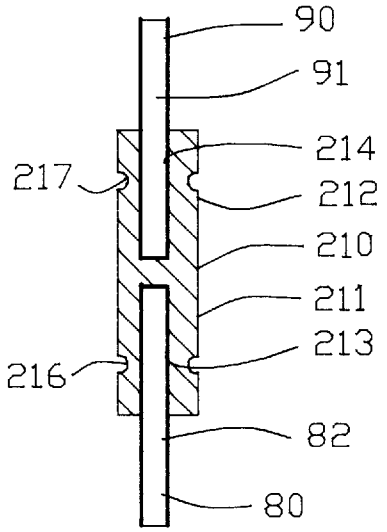
FIG. 21 is an enlarged view of a second embodiment of the coupling means shown in FIGS. 17–19.

FIG. 21 is an enlarged view of a second embodiment of the coupling means 210 shown in FIGS. 17–19. The coupling 210 has a first and a second end 211 and 212 defining an upper and a lower aperture 213 and 214 for respectively receiving the second and first ends 82 and 91 of the reinforcement members 80 and the extension members 90. A first and a second swage 216 and 217 secure the extension members 90 to the reinforcement members 80. The first and second swages 216 and 217 may be created by a swaging device (not shown) such as a mechanical or a hydraulic swaging device for applying sufficient pressure to properly deform the coupling 210 and the necessary mechanical strength.

Figure 22:
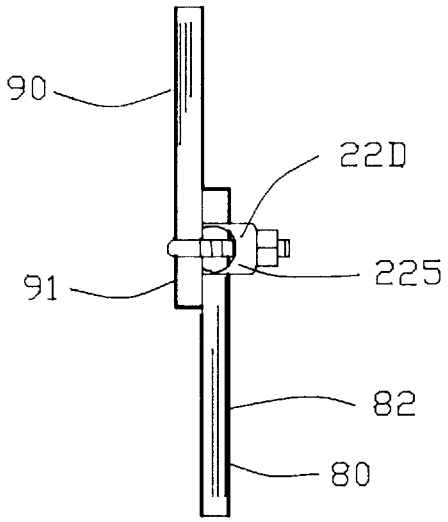
FIG. 22 is an enlarged view of a third embodiment of the coupling means shown in FIGS. 17–19.

FIG. 22 is an enlarged view of a third embodiment of the coupling means 220 shown in FIGS. 17–19 for securing the plurality of extension members 90 to the plurality of reinforcement members 80. The second and first ends 82 and 91 of the reinforcement members 80 and the extension members 90 are positioned to overlap one another. A clamp 225 is positioned at the overlap of the second and first ends 82 and 91 of the reinforcement members 80 and the extension members 90 for securing the plurality of extension members 90 to the plurality of reinforcement members 80.

Figure 23:
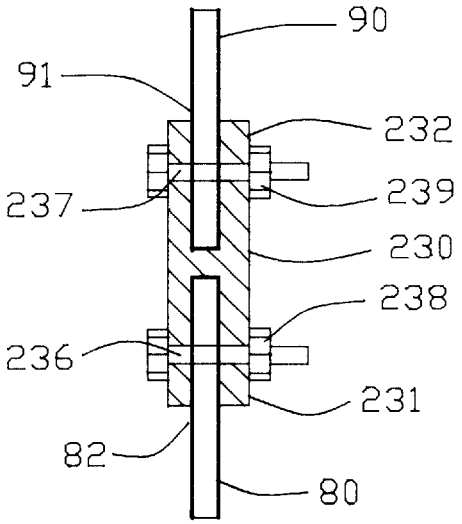
FIG. 23 is an enlarged view of a fourth embodiment of the coupling means shown in FIGS. 17–19.

FIG. 23 is an enlarged view of a fourth embodiment of the coupling means 230 shown in FIGS. 17–19. The coupling 230 has a first and a second end 231 and 232 defining an upper and a lower aperture 233 and 234 for respectively receiving the second and first ends 82 and 91 of the reinforcement members 80 and the extension members 90. A first and a second bolt 236 and 237 extend through the coupling 230 and the second and first ends 82 and 91 of the reinforcement members 80 and the extension members 90 for securing the extension members 90 to the reinforcement members 80. A first and a second nut 238 and 239 retain the first and second bolts 236 and 237.

Figure 24:
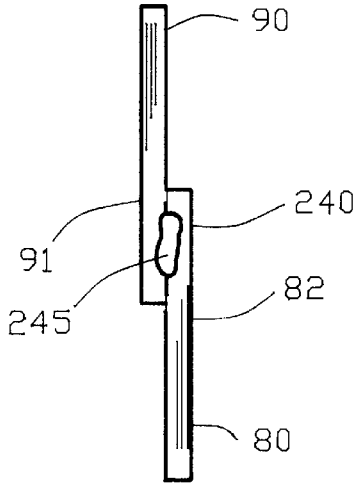
FIG. 24 is an enlarged view of a fifth embodiment of the coupling means shown in FIGS. 17–19.

FIG. 24 is an enlarged view of a fifth embodiment of the coupling means 240 shown in FIGS. 17–19. The second and first ends 82 and 91 of the reinforcement members 80 and the extension members 90 are positioned to overlap one another. A weld 245 secures the overlap of the second and first ends 82 and 91 of the reinforcement members 80 and the extension members 90 for securing the plurality of extension members 90 to the plurality of reinforcement members 80.

Figure 25:
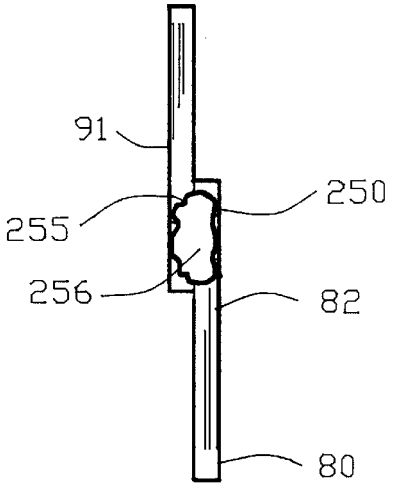
FIG. 25 is an enlarged view of a sixth embodiment of the coupling means shown in FIGS. 17–19.

FIG. 25 is an enlarged view of a sixth embodiment of the coupling means 250 shown in FIGS. 17–19. The second and first ends 82 and 91 of the reinforcement members 80 and the extension members 90 are positioned to overlap one another. A wire wrap 255 temporarily secures the second and first ends 82 and 91 of the reinforcement members 80 and the extension members 90 together. An adhesive 256 is applied to permanently secure the overlap of the second and first ends 82 and 91 of the reinforcement members 80 and the extension members 90.

Figure 26:
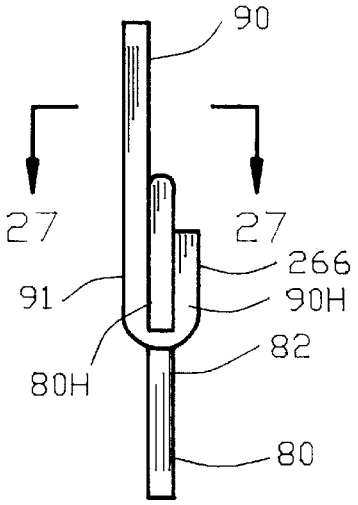
FIG. 26 is an enlarged view of a seventh embodiment of the coupling means shown in FIGS. 17–19.
Figure 27:
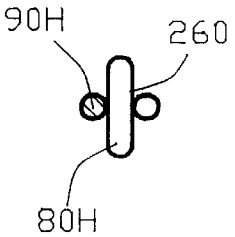
FIG. 27 is a sectional view along line 27—27 in FIG. 26.

FIG. 26 is an enlarged view of a seventh embodiment of the coupling means 260 shown in FIGS. 17–19 whereas FIG. 27 is a sectional view along line 27–27 in FIG. 26. The second and first ends 82 and 91 of the reinforcement members 80 and the extension members 90 are provided with a first and second deformed portion shown as hooks 80H and 90H. The hooks 80H and 90H of the second and first ends 82 and 91 of the reinforcement members 80 and the extension members 90 are interlocked for securing the second and first ends 82 and 91 of the reinforcement members 80 and the extension members 90.

FIG. 18 is an isometric view of a plurality of layers 164–167 of blocks 110, 110', 110" and 110'" comprising the wall 168 constructed as previously described and illustrated in FIGS. 16 and 17. The blocks 110', 110" and 110'" are positioned relative to the blocks 110 of the lower layer for interlocking the blocks within the plurality of layers 164–167.

Figure 28:
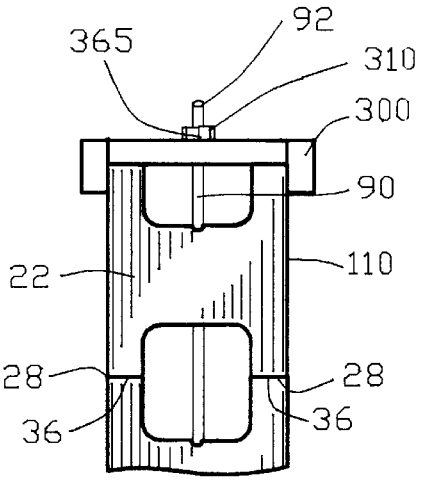
FIG. 28 is an enlarged end view of the retainer disposed on the interlocking blocks in FIGS. 18 and 19.

FIG. 28 is a side view illustrating the top surface of the top course 167 of the interlocking foam blocks 110 with a retainer 300 disposed thereon. Preferably, the reinforcement members 80 and/or the extension members 90 extend above the top course 167 of the interlocking foam blocks 110. The retainer 300 is positioned onto the top surface of the top course 167 of the interlocking foam blocks 110. The retainer 300 is provided with apertures 305 for receiving the second end 92 of the extension members 90. A plurality of binders 310 engages with the second ends 92 of the plurality of extension members 90 for securing the retainer 300 into engagement with the top surface of the top course 167 of the interlocking foam blocks 110 for stabilizing the wall 168 during the process of pouring a concrete material 72 within the vertical apertures 140 of the interlocking foam blocks 110. Preferably, the binders 310 are mechanical fasteners such as nuts engaging threaded second ends 92 of the extension members 90.

FIG. 19 illustrates the delivery of slurry of curable material 72 such as a cementitious material, concrete or the like from a delivery means 74. The delivery means 74 delivers the slurry of the curable material 72 to the plurality of vertical apertures 140 in blocks 110'" of layer 167 which communicates with the plurality of vertical apertures 140 of the plurality of layers 164–167. The curable material 72 provides a contiguous matrix 176 of curable material 72 such as concrete or the like. The vertically extending reinforcement members 80 and/or the extending members 90 maintain the position of the courses 164–167 of the interlocking foam blocks 110 during the filling process.

In the past, the prior art interlocking foam blocks had a tendency of separating or floating during the concrete pouring process. The device of the present invention eliminates the possibility of the interlocking foam blocks separating or floating during the concrete pouring process. The present invention stabilizes the interlocking foam blocks during the erection and assembly process as well as stabilizing the interlocking foam mold blocks during the process of pouring of the concrete. The present invention eliminates the need for externally reinforcing or stabilizing the interlocking foam mold blocks. The elimination of the need for externally reinforcing or stabilizing the interlocking foam mold blocks provides a substantial material and labor savings.

Figure 29:
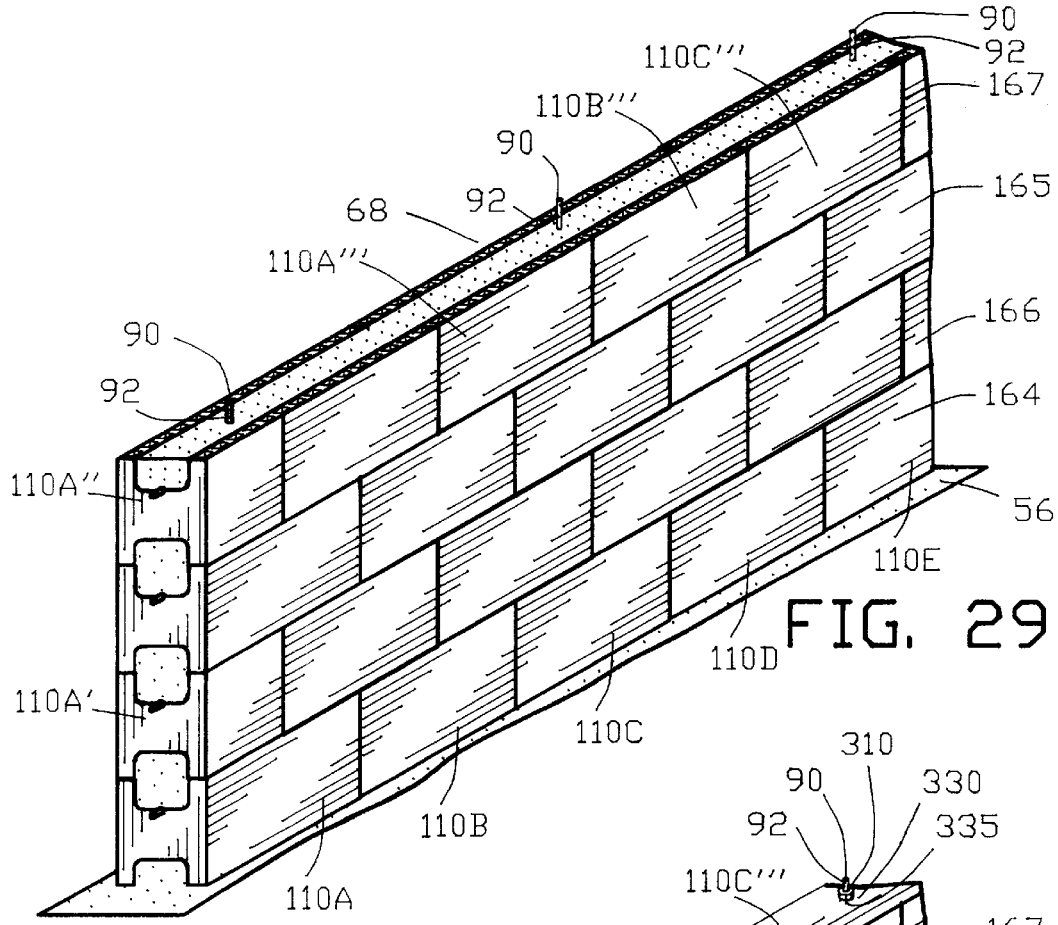
FIG. 29 is an isometric view of the wall comprising four layers of interlocking blocks with a construction plate thereon.

FIG 29 illustrates the top surface of the top course 167 of the interlocking foam blocks 110 after curing of the curable material 72 and the removal of the retainer 300. After the pouring process of the curable material 72 has been completed, the plurality of binders 310 are removed and the retainer 300 is removed from the top surface of the top course 167 of the interlocking foam blocks 110.

FIG. 29 is an isometric view of the wall 168 comprising four layers 164–167 of interlocking blocks 110 with a construction plate 330 disposed thereon. Preferably, the construction plate 330 is made of wood material and is positioned on the top surface of the top course 167 of the interlocking foam blocks 110. The construction plate 330 is provided with a plurality of apertures 335 for receiving the second ends 92 of the extension members 90 extending from the concrete wall 168.

Figure 30:
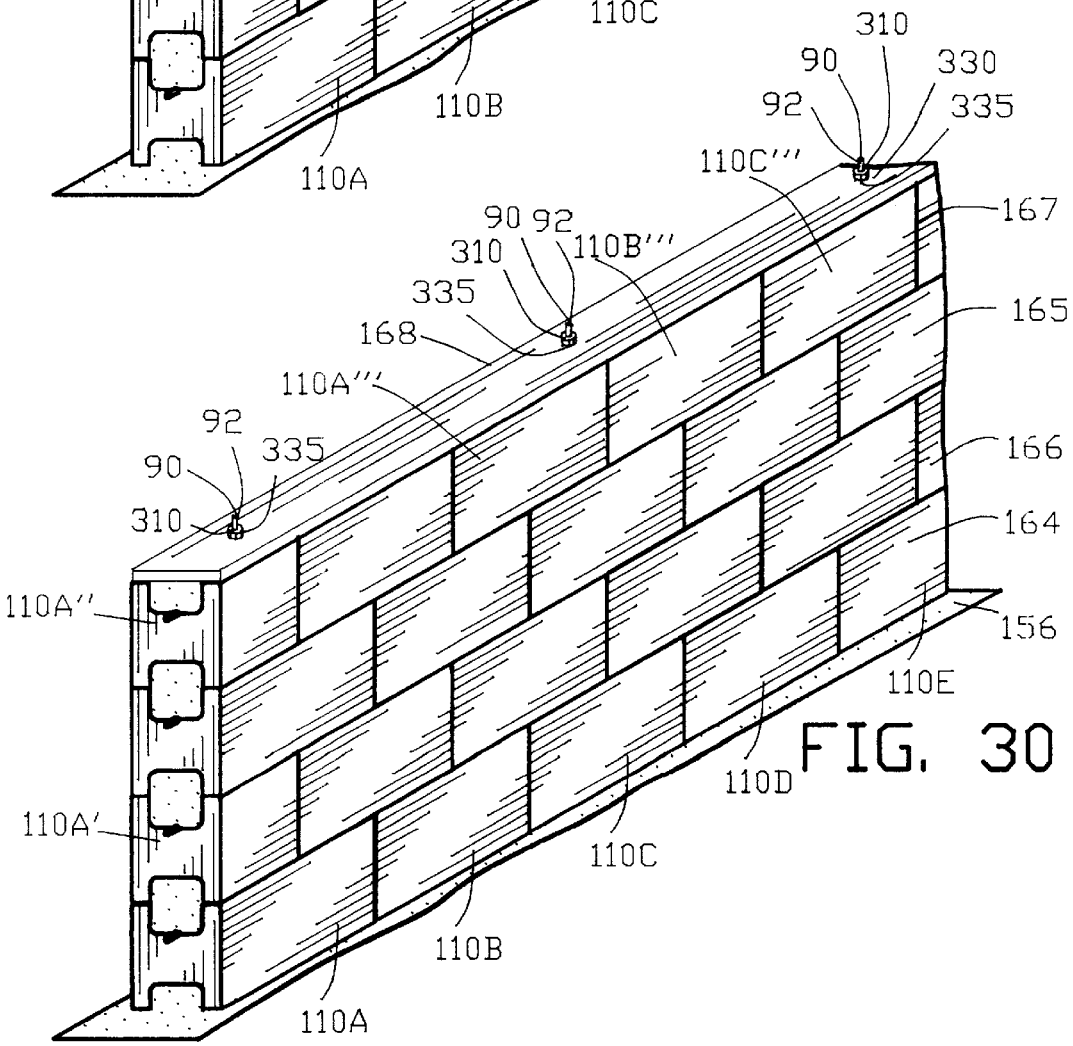
FIG. 30 is an isometric view of the wall comprising four layers of interlocking blocks with the construction plate secured with a plurality of binders.

FIG. 30 is an isometric view of the wall 168 comprising four layers 164–167 of interlocking blocks 10 with the construction plate 330 secured with a plurality of binders 310. Preferably, the binders 310 are mechanical fasteners such as nuts engaging threaded second ends 92 of the extension members 90. This secures the construction plate 330 firmly to the foundation 56 through the reinforcement members 80, the coupling 100 and the extending members 90. Typically, the construction plate 330 is used to secure the roof to the building structure.

The stabilizing system of the present invention enables the walls of a building structure to be anchored to the foundation. Building structures fabricated in accordance with the present invention will be stronger, more wind resistant and less effected by high winds such as hurricanes and tornados than heretofore known in the art. The present invention stabilizes the foam blocks during the concrete pouring process and provides an anchor for anchoring the construction plate after the concrete pouring process has been completed. Accordingly, the present invention provides a dual purpose of stabilizing the foam blocks during the pouring process and for anchoring the roof structure after completion of the pouring process.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved stabilizing system for a poured concrete wall comprising a plurality of courses of foam blocks disposed on a foundation, with each of the foam blocks having an internal cavity for receiving a concrete material:

a plurality of reinforcement members with each of said plurality of reinforcement members having a first and a second end;

means for securing said first end of each of said plurality of reinforcement members within the foundation with said second end of each of said plurality of reinforcement members extending in a vertical orientation through the internal cavities within the foam blocks;

a plurality of retainers disposed on and intermittently spaced along an upper surface of the plurality of courses of the foam blocks for enabling the pouring of the concrete material into the internal cavities of the foam blocks between said plurality of retainers;

a plurality of binders engaging with said second ends of said plurality of members securing said plurality of retainers into engagement with said upper surface of the plurality of courses of the foam blocks for stabilizing the wall during the process of pouring the concrete material within the internal cavities of the foam blocks; and said plurality of binders being removable from said second ends of said plurality of members for removing said plurality of retainers from said upper surface of the plurality of courses of the foam blocks after pouring the concrete material within the internal cavities of the foam blocks.

2. The improved stabilizing system for a poured concrete wall as set forth in claim 1, wherein said means for securing said first end of each of said plurality of reinforcement members within the foundation comprises each of said first ends of said reinforcement members being angled securing each of said reinforcement members to the foundation.

3. The improved stabilizing system for a poured concrete wall as set forth in claim 1, wherein each of said plurality of binders are removable for enabling the removal of said retainer after the internal cavities of the foam blocks are filled with the concrete material.

4. The improved stabilizing system for a poured concrete wall as set forth in claim 1, wherein each of said plurality of binders comprising a threaded binder for enabling the removal of said retainer after the internal cavities of the foam blocks are filled with the concrete material.

5. The improved stabilizing system for a poured concrete wall as set forth in claim 1, including a construction plate having a plurality of plate apertures engaging the upper surface of the plurality of courses of the foam blocks with said second ends of said plurality of members extending through said plurality of plate apertures; and said plurality of binders engaging with said second ends of said plurality of members for securing said construction plate to the upper surface of the plurality of courses of the foam blocks.

6. An improved stabilizing system for a poured concrete wall comprising foam blocks disposed on a foundation, with each of the foam blocks having an internal cavity for receiving a concrete material:

a plurality of reinforcement members with each of said plurality of reinforcement members having a first and a second end;

a plurality of extension members with each of said plurality of extension members having a first and a second end;

means for securing said first end of each of said plurality of reinforcement members within the foundation with said second end of each of said plurality of reinforcement members extending in a vertical orientation;

means for securing said second ends of said plurality of reinforcement members to said first ends of said plurality of extension members with said plurality of extension members extending in the vertical orientation;

a plurality of retainers disposed on and intermittently spaced along an upper surface of the plurality of courses of the foam blocks for enabling the pouring of the concrete material into the internal cavities of the foam blocks between said plurality of retainers; and a plurality of binders engaging with said second ends of said plurality of extension members securing said plurality of retainers into engagement with said upper surface of the plurality of courses of the foam blocks for stabilizing the wall during the process of pouring the concrete material within the internal cavities of the foam blocks; and said plurality of binders being removable from said second ends of said plurality of extension members for removing said plurality of retainers from said upper surface of the plurality of courses of the foam blocks after the pouring concrete material within the internal cavities of the foam blocks.

7. An improved stabilizing system for a poured concrete wall comprising foam blocks disposed on a foundation, with each of the foam blocks having an internal cavity for receiving a concrete material:

a plurality of reinforcement members with each of said plurality of reinforcement members having a first and a second end;

a plurality of extension members with each of said plurality of extension members having a first and a second end;

means for securing said first end of each of said plurality of reinforcement members within the foundation with said second end of each of said plurality of reinforcement members extending in a vertical orientation;

a plurality of coupling means securing said second ends of said plurality of reinforcement members to said first ends of said plurality of extension members with said plurality of extensions members extending in the vertical orientation;

a plurality of retainers disposed on and intermittently spaced along an upper surface of the plurality of courses of the foam blocks for enabling the pouring of the concrete material into the internal cavities of the foam blocks between said plurality of retainers; and a plurality of binders engaging with said second ends of said plurality of extension members securing said plurality of retainers into engagement with said upper surface of the plurality of courses of the foam blocks for stabilizing the wall during the process of pouring the concrete material within the internal cavities of the foam blocks; and said plurality of binders being removable from said second ends of said plurality of extension members for removing said plurality of retainers from said upper surface of the plurality of courses of the foam blocks after the pouring the concrete material within the internal cavities of the foam blocks.

8. The improved stabilizing system for a poured concrete wall as set forth in claim 7, wherein each of said plurality of reinforcement members comprises a steel reinforcement bar; and each of said plurality of extension members comprises a steel reinforcement bar.

9. The improved stabilizing system for a poured concrete wall as set forth in claim 7, wherein said means for securing said first end of each of said plurality of reinforcement members within the foundation comprises each of said first ends of said reinforcement members being angled securing each of said reinforcement members to the foundation.

10. The improved stabilizing system for a poured concrete wall as set forth in claim 7, wherein said means for securing said first end of each of said plurality of reinforcement members within the foundation comprises each of said first ends of said reinforcement members being secured to horizontally extending reinforcement members within the foundation.

11. The improved stabilizing system for a poured concrete wall as set forth in claim 7, wherein each of said plurality of coupling means comprises said first and second ends of said plurality of reinforcement members and said first and second ends of said plurality of extension members being threaded; and each of said plurality of coupling means comprises a first and a second thread threadably securing said second ends of said plurality of reinforcement members to said first ends of said plurality of extension members.

12. The improved stabilizing system for a poured concrete wall as set forth in claim 7, wherein each of said plurality of coupling means comprises a first and a second deformed portion securing said second ends of said plurality of reinforcement members to said first ends of said plurality of extension members.

13. The improved stabilizing system for a poured concrete wall as set forth in claim 7, wherein each of said plurality of coupling means comprises cylindrical members having a first and a second portion; and said first and second portions of each of said plurality of coupling means being deformed securing said second ends of said plurality of reinforcement members to said first ends of said plurality of extension members.

14. The improved stabilizing system for a poured concrete wall as set forth in claim 7, wherein each of said plurality of coupling means comprises cylindrical members having a first and a second portion; and said first and second portions of each of said plurality of coupling means being swaged securing said second ends of said plurality of reinforcement members to said first ends of said plurality of extension members.

15. The improved stabilizing system for a poured concrete wall as set forth in claim 7, wherein each of said plurality of coupling means comprises said first and second ends of said plurality of reinforcement members and said first and second ends of said plurality of extension members having an aperture; and each of said plurality of coupling means comprises a first and a second coupling aperture and a first and a second fastener for securing said second ends of said plurality of reinforcement members to said first ends of said plurality of extension members.

16. The improved stabilizing system for a poured concrete wall as set forth in claim 7, wherein each of said plurality of binders are removable for enabling the removal of said retainer after the internal cavities of the foam blocks are filled with the concrete material.

17. The improved stabilizing system for a poured concrete wall as set forth in claim 7, wherein each of said plurality of coupling means comprises said first and second ends of said plurality of reinforcement members and said first and second ends of said plurality of extension members being threaded;

each of said plurality of coupling means comprises a first and a second thread threadably securing said second ends of said plurality of reinforcement members to said first ends of said plurality of extension members; and each of said plurality of binders comprises a threaded binder for enabling the removal of said retainer after the internal cavities of the foam blocks are filled with the concrete material.

18. The improved stabilizing system for a poured concrete wall as set forth in claim 7, including a construction plate having a plurality of plate apertures for engaging the upper surface of the plurality of courses of the foam blocks with said second ends of said plurality of extension members extending through said plurality of plate apertures; and said plurality of binders engaging with said second ends of said plurality of extension members securing said construction plate to the upper surface of the plurality of courses of the foam blocks.

* * * * *